United States Patent [19]

Wysong

[11] 4,347,818

[45] Sep. 7, 1982

[54] EXTERNALLY CONTROLLED FUEL DELIVERY CURVE ADJUSTMENT MECHANISM FOR A FUEL INJECTION PUMP

[75] Inventor: Bryan M. Wysong, Hartford, Conn.

[73] Assignee: Stanadyne, Inc., Windsor, Conn.

[21] Appl. No.: 142,443

[22] Filed: Apr. 21, 1980

[51] Int. Cl.[3] ..... F02D 7/00

[52] U.S. Cl. ..... 123/369; 123/387; 417/253

[58] Field of Search ..... 123/385, 386, 387, 388, 123/369, 365, 502, 503; 417/253

[56] References Cited

U.S. PATENT DOCUMENTS

| | | | |
|---|---|---|---|
| 2,929,369 | 3/1960 | Staege | 123/369 |
| 2,929,370 | 3/1960 | Staege | 123/369 |
| 3,927,653 | 12/1975 | Pagdin | 123/369 |
| 4,200,076 | 4/1980 | Straubel | 123/369 |
| 4,292,940 | 10/1981 | Bailey | 123/387 |

*Primary Examiner*—Charles J. Myhre
*Assistant Examiner*—Carl Stuart Miller
*Attorney, Agent, or Firm*—Prutzman, Kalb, Chilton & Alix

[57] ABSTRACT

A fuel injection pump with a metering valve for metering the fuel charge delivered by the pump and a torque cam piston to set a maximum fuel charge limit, the torque cam piston being axially positioned by fuel transfer pressure in accordance with the pump speed and being angularly adjusted manually. Several embodiments of a torque cam profile are shown in which the cam profile is provided by one or more surfaces of revolution and wherein at least one such surface of revolution has an axis inclined to the axis of the piston.

5 Claims, 13 Drawing Figures

EXTERNALLY CONTROLLED FUEL DELIVERY CURVE ADJUSTMENT MECHANISM FOR A FUEL INJECTION PUMP

The present invention relates to fuel injection pumps for supplying precisely measured charges of liquid fuel under high pressure to an internal combustion engine and more particularly to such a pump having means for adjusting the schedule of maximum fuel delivery at different engine speeds.

It is the principal object of this invention to provide a new and improved fuel injection pump having means for adjusting the maximum fuel delivery to adjust the maximum power output of an engine independently of two different speeds. Included in this object is to provide a new and improved arrangement for adjusting the maximum power output of the engine at one speed without changing it at another.

Another object of this invention is to provide a new and improved fuel injection pump including an improved arrangement for easily adjusting the schedule of the maximum quantity of fuel delivered by the pump per pumping stroke according to engine speed during production testing of the engine.

Other objects will be in part obvious and in part pointed out more in detail hereinafter.

A better understanding of the invention will be obtained from the following detailed description and the accompanying drawings of an illustrative application of the invention.

Figures 1, 2:
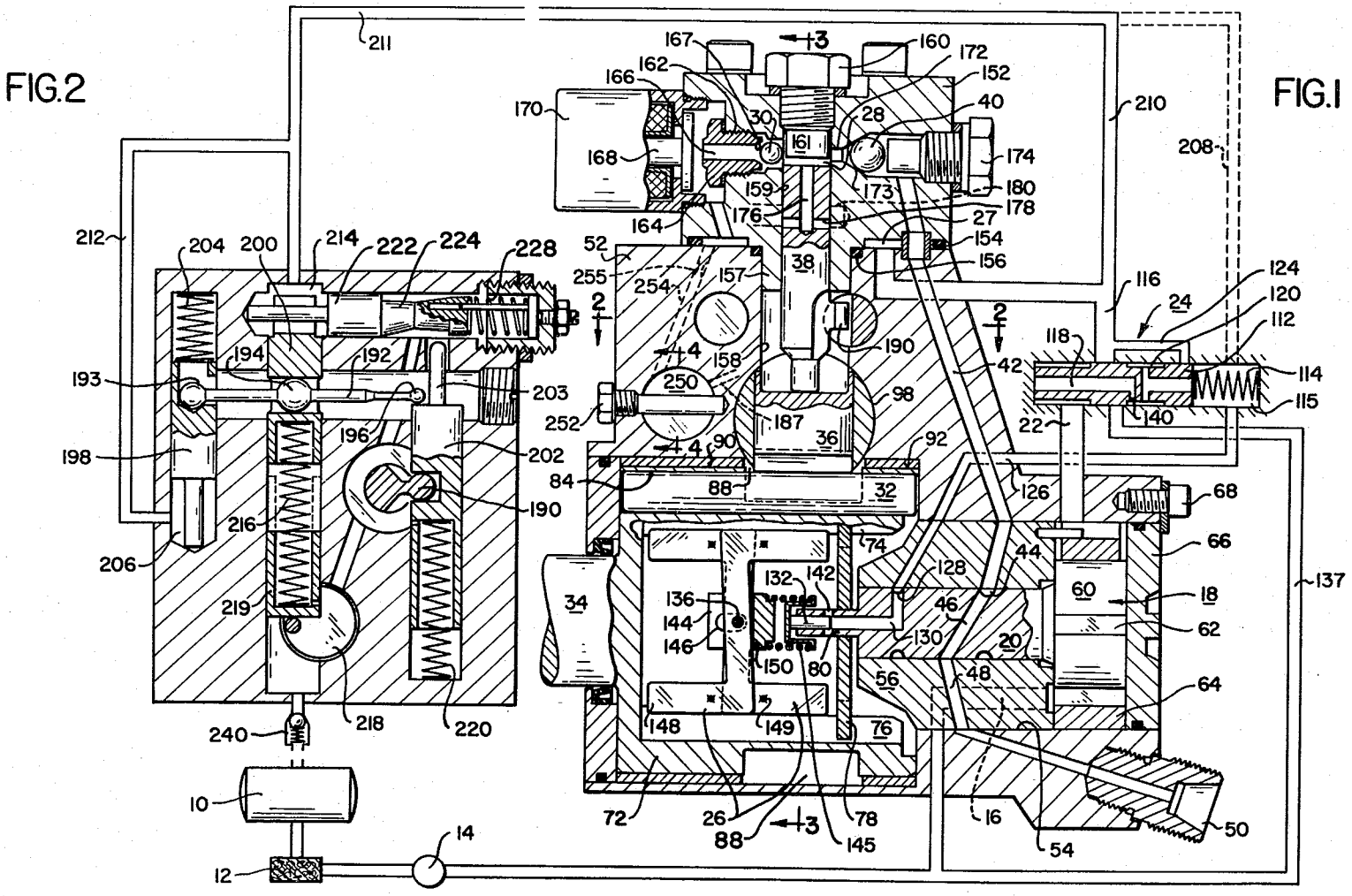
FIG. 1 is an illustrative embodiment of the new and improved fuel injection pump of the present invention, partly in longitudinal cross-section and partly schematic.
FIG. 2 is a cross-sectional view along line 2—2 of FIG. 1.

Referring now to the drawings, and particularly to FIG. 1, fuel from a fuel tank 10 is shown as being delivered through a fuel filter 12 and a low pressure boost pump 14 to the inlet 16 of a positive displacement vane type transfer pump 18 drivingly connected to the distributor rotor 20 to rotate therewith. The output of the transfer pump 18 is delivered by a passage 22 to a pressure regulator 24 which cooperates with flyweights 26 to provide a hydraulic pressure correlated with engine operating speed.

Fuel from pressure regulator 24 and having a speed related pressure is delivered to an annulus 27 from which it is delivered to the high pressure pump chamber 28 past an inlet ball check valve 30. When the pumping chamber 28 is filled, a roller 32 mounted by the drive shaft 34 engages a tappet 36 to transmit an upward stroke to the high pressure pump plunger 38 to pressurize the fuel in pump chamber 28 and deliver the pressurized fuel to the distributor rotor 20 past one-way delivery valve 40, through passage 42 which continuously communicates with annulus 44 of the distributor rotor 20. The fuel flows through diagonal passage 46 in the distributor rotor to a delivery passage 48 when diagonal passage 46 and delivery passage 48 are in registry to deliver the charge of fuel to outlet nipple 50 for delivery to an associated fuel injection nozzle of the engine.

Further rotation of the rotor 20 produces sequential pumping strokes of pump plunger 28 to pressurize and deliver sequential charges of fuel to the other nipples (not shown) corresponding to nipple 50 which are disposed around the periphery of the pump and have delivery passages which sequentially register with the single diagonal passage 46 during each pumping stroke of pump plunger 28 as the rotor 20 rotates.

To discuss the foregoing in greater detail, the illustrative pump includes a housing 52 provided with a stepped bore 54 in which an annular sleeve 56 is permanently fixed and sealed. The annular sleeve 56 is in turn provided with a bore in which the rotor 20 is precision journaled for rotation therein. The right end of the sleeve 56 is spaced from the end of the housing to receive an enlarged hub 60 on the end of the rotor 20. The hub 60 is provided with a pair of intersecting radial slots in which pumping vanes 62 are mounted for reciprocation as a result of their engagement with the inner surface of eccentric ring 64. An end plate 66 is sealed within the end of the bore 54 and is secured therein by any suitable means such as a plurality of retaining screws 68 (only one of which is shown).

The drive shaft 34 is adapted to be driven by the associated engine and is provided with an enlarged hollow cylindrical bearing hub 72 which is sized so as to be journaled by a bushing within a larger portion of the stepped bore 54 of the housing which serves as a backing surface therefor.

The interior of the hollow hub 72 is provided with a pair of longitudinally extending grooves 74, 76 which receives the ears of a rotor drive plate 78. The rotor 20 is provided with an axially projecting noncircular hollow drive tang 80 which is received within a mating centrally disposed aperture of the drive plate 78 for drivingly connecting the rotor 20 to the drive shaft 70 without imparting axial or radial forces therebetween.

The enlarged bearing hub 72 of the drive shaft 70 is provided with a plurality of longitudinally extending spaced bores 84 in which rollers 32 are journaled. The longitudinal midsection of the hub 72 is turned to a reduced diameter as indicated at 88 to intersect the bores 84 and expose the rollers 86. Uninterrupted cylindrical bearing surfaces 90 and 92 are provided at the ends of hub 72. A plurality of radially extending passages 94 (FIG. 3) are provided through the hub 72 so as to provide free communication between the interior and the exterior of the midsection of the hub.

The pump housing 52 is provided with a mounting flange 95 (FIG. 3) having elongated apertures 96 for receiving mounting bolts to secure the pump to a mounting pad of the associated engine.

The pump housing 52 is also provided with a transverse bore 98 (FIG. 3) for slidably receiving a timing piston 100. End caps 102 seal the ends of the bore 98, and a pin 101 received in a longitudinal groove 103 of the advance piston secures the advance piston against rotation relative to the housing 52.

The advance piston 100 includes a cross bore for slidably mounting the tappet 36, and a cross pin 106, secured in a cross bore of the advance piston, is engageable with a shoulder 108 of the tappet 36 to rotationally orient and limit the downward movement of the tappet. Tappet 36 is provided with a plurality of openings 110 which serve to limit the mass of the tappet and also to provide open communication between its upper and lower surfaces for the free passage of fuel therebetween.

The tappet 36 is provided with an upper flat surface to engage the end of the pump plunger 38 to transmit the pumping force from the rollers 32 to provide the pumping stroke of the plunger upon the rotation of the drive shaft 70.

Referring again to FIG. 1, the pressure regulator 24 is provided with a regulator piston 112 and includes a spring 114 which biases the regulator piston 112 to the left to shut off outlet passage 116 and prevent fuel from the transfer pump 18 to flow to the high pressure pump chamber 38 when the pump is not rotating.

As cranking begins, and the rotor 20 and the transfer pump 18 begin to rotate, the output of transfer pump 18 moves the regulator piston to the right against the bias of spring 114 to uncover the inlet port of passage 116 to provide fuel to the high pressure pump chamber 28. Fuel also flows through the axial passage 118 of regulator piston 112 and into the annulus 120 thereof to deliver fuel to spring chamber 115 which is in continuous communication with passage 130 of the rotor 20 through passage 126 and annulus 128. Spill from passage 130 is regulated by a pin 132 and ports 142 in response to the centrifugal force of Z-shaped flyweights 26 pivotally mounted on pin 136 disposed on a diameter of the hub 72.

Since fuel is supplied to spring chamber 115 at all times when the pump is rotating, spill from the passage 130 will determine the pressure within the spring chamber 115 and thus the hydraulic force which cooperates with the spring 114 to act on the regulator piston 112 against the bias of the output pressure of the transfer pump 18. Thus, the regulated output pressure in passage 116 is maintained at a level determined by the spring force of spring 114 plus the amount of hydraulic pressure in the spring chamber 115. Regulator piston 112 under the bias of spring 114 also serves to cut off fuel to the passage 116 in the even of loss of fuel input to the pump.

An optional additional feed passage 124 provides communication between the annulus 120 and the speed related output pressure in passage 116 except during the initial cranking of the engine.

As the speed of rotation builds up, and the transfer pump output pressure increases, the regulator piston 112 moves to the right to uncover the return passage 137 to return any additional fuel to the inlet 16 of transfer pump 18.

The axial passage 118 in regulator pin 112 communicates with spring chamber 115 through a port 140 and annulus 120 which has a limited radial clearance to form a fixed restriction or orifice in the flow path from passage 118 to spring chamber 115.

Since the pressure differential between the ends of piston 112 must be equivalent to the force of spring 114 in order to maintain piston 112 in equilibrium, the flow of fuel into chamber 115 through orifice 120 and auxiliary passage 124 is constant under all normal operating conditions and this constant amount of fuel will be spilled to low pressure in the roller cavity through spill ports 142 which are controlled by pin 132 so that the force exerted on pin 132 by the fuel in passage 130 is equal to the force exerted on pin 132 by flyweights 26, thereby causing the pressure in passage 130 and spring chamber 115 to be a function of speed. In the event that the fuel supply to the pump becomes restricted so that the pressure in passage 130 cannot equal flyweight force, pin 132 will close ports 142 and there will be no flow in this circuit, and since there is no flow from one end of regulator piston 112 to the other end, there will be no pressure drop and spring 114 will push piston 112 to its extreme left hand position closing the feed to passage 116 and pumping chamber 28 thereby terminating engine operation when the pressure in passages 130 and 116 is incorrect for proper control.

Accordingly, the pressure level in spring chamber 115 is determined by the axial force applied to the pin 132 by the pair of Z-shaped flyweights 26 acting about their pivot 136 through U-shaped saddle 144. The two legs of U-shaped saddle 144 straddle the Z-shaped flyweights and are provided with elongated holes 146 which receive the pivot pin 136 and permit the axial movement of the U-shaped saddle 144.

Rotation of the drive shaft 34 creates a centrifugal force on the center of mass 149 of the flyweight sections which is opposed by the hydraulic force on pin 132 acting through spring 145, which preferably has a constant spring rate, and U-shaped saddle 144.

The square end of pin 132 will uncover ports 142 to provide the required spill area and the change of area required to adjust spill as speed changes to regulate the pressure in chamber 115 according to speed.

The pump is provided with a pump unit 152 secured to the housing 52 and is sealed thereto by any suitable means such as O-rings 154, 156. The pumping unit 152 is provided with a cylindrical projection 157 which is received within the readial bore 158 of the pump housing in alignment with the tappet 36. The pump unit 152 provides a bore 159 which serves as a cylinder for the pump plunger 38 with the cylinder bore 159 being closed at its upper end by a threaded plug 160 which seals the end of the cylinder bore 159 and is provided with an extension 161 which limits the lift of ball valve 30.

A laterally extending threaded passage 162 communicating with cylinder bore 159 receives an externally threaded ferrule 164 which has a central passage 166, one end of which provides a seat 167 for the one way inlet ball check valve 30 which seals the high pressure pump chamber 28 during the pumping stroke of plunger 38. The opposite end of ferrule 164 is engaged by the plunger 168 of electromagnetic shut-off valve 170 which serves to prevent the entry of fuel into the pump chamber 28 except when the electromagnetic shut-off valve 170 is energized.

A second laterally extending passage 172 communicates with the pump chamber 28 and provides a conical seat 173 for the ball valve 46 which serves as a delivery valve to maintain pressure in the passage 42 between pumping strokes. Passage 172 is sealed by a threaded plug 174 which also serves to limit the lift of the ball valve 40 from its seat. If desired, a conventional delivery valve may be substituted for the ball valve 40.

The plunger 28 is provided with an axial passage 176 which intersects a second transverse passage 178 which comes into registry with a larger diameter passage 180 communicating with the bore 184 (FIG. 3) to terminate the pumping stroke by spilling the remaining fuel in the pumping chamber 28 into the spill chamber 182 until the spring biased piston 185 forming a movable wall of the spill chamber opens a dump port 186 to discharge the remaining fuel spilled from the pumping chamber 28. Since the passage 178 in the plunger 38 is significantly smaller than the passage 180 in the bore 159, angular rotation of the plunger 38 will result in varying the vertical position at which the passages 178 and 180 will overlap and hence a different vertical position at which the pumping stroke will terminate by spilling the remainder of the pressurized fuel in pumping chamber 28. Accordingly, the amount of fuel delivered by a single pumping stroke is determined by the angular position of the pump plunger 38 relative to the spill passage 180.

As hereinbefore described, the speed related output pressure of the transfer pump 18 is present in the passage 116 and in fuel supply annulus 27. This pressure is used to actuate a governor by controlling the angular rotation of pump plunger 38 through its laterally extending arm 190.

As shown in FIG. 2, the governor is provided with a beam 192 having three spherical fulcrums 193, 194 and 196 so that it may freely rotate. Spherical fulcrum 193 engages a recess in overspeed piston 198. Spherical fulcrum 194 engages governor piston 200 and spherical fulcrum 196 engages plunger control piston 202 to control the angular position of the arm 190 of pump piston 198 against the bias of spring 220.

In normal operation, overspeed piston 198 remains in a fixed position unless the pressure in chamber 206 becomes sufficiently great to overcome the force of spring 204 and provide maximum speed governing. It will be observed that the chamber 2-6 communicates with passage 116 through passages 210, 211, 212.

Optionally, the pressure in spring chamber 115 may be connected to the governor as indicated by the dotted lines 208 of FIG. 1 and the passage 210 eliminated.

If the pressure in chamber 206 exceeds a predetermined level indicative of an overspeed condition, the fulcrum 196 of the beam 192 depresses plunger control piston 202 to rotate pump plunger arm 190 and reduce fuel delivery by rotating the pump plunger 38 to cause an earlier overlap between spill passage 180 and passage 178 of the pump plunger.

The governor piston 200 is subjected to the speed related hydraulic pressure in chamber 214 on one end and to the biasing force of spring 216 on the opposite end. The spring force may be varied by the position of the throttle 218 and governing results by the movement of the spherical fulcrum 194 upwardly upon a reduced pressure in chamber 214 indicative of a reduction in speed to enable the plunger control piston 202 to move upwardly under the bias of spring 220 by an amount controlled by spherical fulcrum 196. Where the piston 210 is spaced from governor piston 200 as shown in solid lines in FIG. 2, full range governing is provided. If the spacing shown by the dotted lines is used, the gap between pistons 200 and 219 will close at a speed just above idle speed, and governing will take place only at idle speed and at maximum speed, with the amount of fuel delivered at intermediate speeds being controlled manually by the position of throttle 218.

A torque control piston 222, which schedules the maximum amount of fuel which may be delivered in a single pumping stroke of plunger 38, is slidably mounted in a transverse bore in housing 52. One end of the torque control piston 222 is subject to the pressure in chamber 214 and spring 228 biases piston 222 toward chamber 214. Plunger control piston 202 is provided with an extension 203 engageable with a profiled surface 224 which limits the maximum fuel which may be pumped per pumping stroke according to the axial position of the torque control piston 222 which in turn is determined by the pressure in chamber 214 and hence the speed of the pump.

During cranking, when the pressure in chamber 214 is substantially zero, the governor spring 216 will move the governing piston 200 to its top position thereby permitting spring 220 to angularly adjust the arm 190 of the pumping plunger 38 for maximum fuel delivery.

Figure 3:
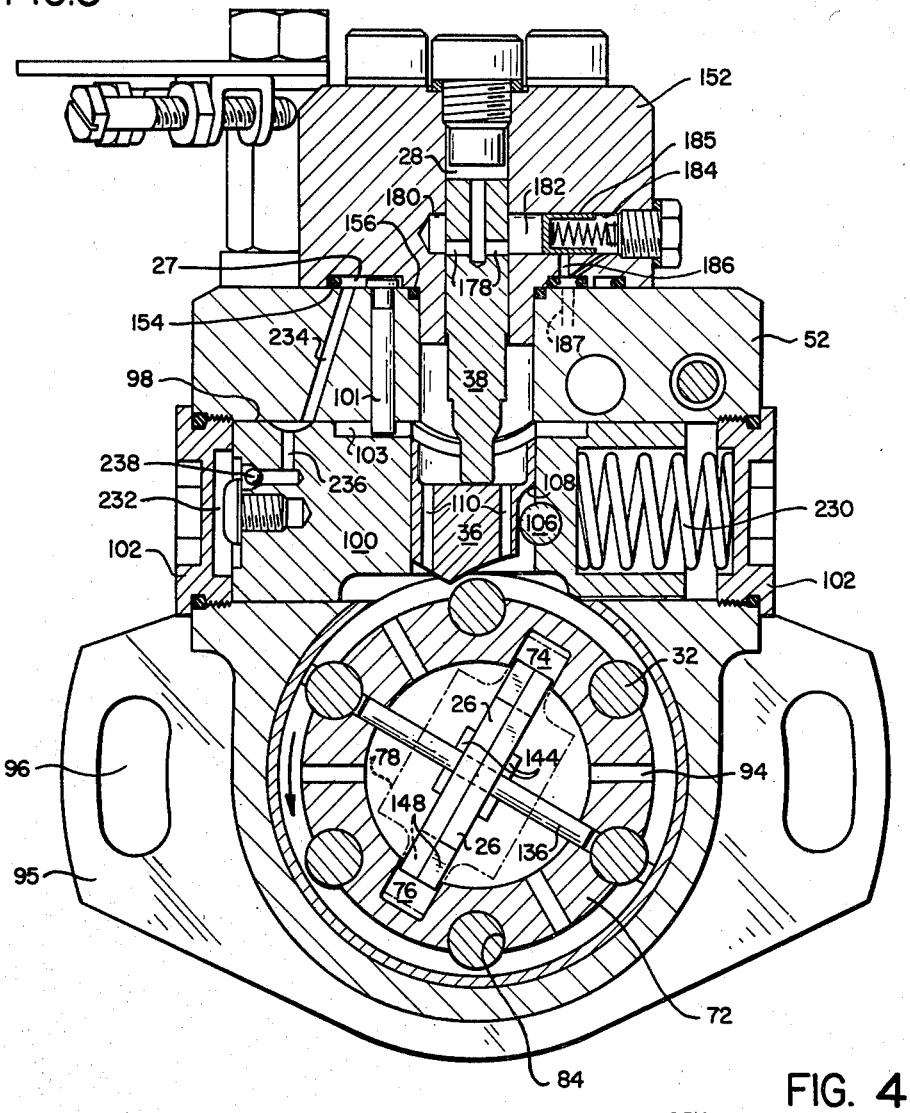
FIG. 3 is an enlarged transverse cross-sectional view taken along the line 3—3 of FIG. 1.
Figure 4:
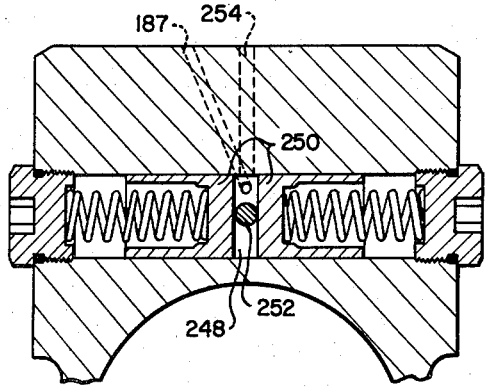
FIG. 4 is a fragmentary cross-sectional view taken along line 4—4 of FIG. 1.

As shown in FIG. 3, the position of tappet 36 may be adjusted to advance and retard the timing of the pumping stroke and hence the timing of injection by the lateral adjustment of the advance plunger 100 against the bias of a spring 230. Transfer pump regulated pressure in fuel supply annulus 27 communicates with a chamber 232 at the end of advance piston 100 through passages 234 and 236 and past a one way check valve 238. Controlled leakage past the advance piston 100 permits the advance piston 100 to move to a retard position under the influence of the force transmitted between the rollers 32 and the camming surface of the tappet 36 during pumping strokes.

As is conventional, the pump housing 52 is filled with fuel for lubrication purposes and any leakage past any piston or plunger of the pump is ultimately returned to the fuel tank past a spring biased one way valve 240 (FIG. 2) which maintains a positive pressure in the pump to prevent the collection of air within the pump and to assure that the pump is continuously full of fuel.

As hereinbefore stated, the output of the transfer pump is in continuous communication with the fuel supply annulus 27 at all times during the operation of the pump. Upon the termination of the pumping stroke of plunger 38 by the registry of passages 178 and 180 (FIG. 3), the inlet check valve 30 may immediately unseat so that the pump chamber 28 may be refilled. Whenever the pressure in the pump chamber 28 is lower than the pressure in fuel supply annulus 27, the plunger 38 is hydraulically powered to its lowest position with the shoulder 108 engaging the stop 106 to assure a complete filling of the chamber 28 prior to every pumping stroke.

If desired, and as shown in FIG. 3, the spill chamber 182 may be provided to assist in the initial filling of the pump chamber 28. The biasing spring for accumulator piston 185 may be selected to maintain a high pressure, say, 200 psi, on the fuel contained therein thereby to provide initial impetus to overcome any hydraulic inertia to the flow of fuel from fuel supply annulus 27 at the beginning of the filling stroke. In addition, and as shown in FIGS. 1 and 5, an additional accumulator may be connected to annulus 27 by passage 254 having a restrictor 255 to serve as an auxiliary source of fuel to even out any pulsations of fuel pressure caused by the sudden changes in the demands for fuel in charging the pump chamber 28. This accumulator is shown as being connected to receive the fuel dumped by spill chamber 182 through dump port 186 (which is isolated from fuel supply annulus 27) and passage 187 to prevent fluctuations in the pressure in annulus 27 due to the sudden spill of fuel from spill chamber 182. Such an accumulator may be provided by a pair of spring biased pistons 250 spaced by a pin 252 to assure a minimum sized chamber connected to the annulus 27 by a passage 254 (FIG. 1).

Different engines of the same engine model should conform to the same power standards and, due to manufacturing variations and tolerances, not all engines of the same model will fall within specification limits at peak torque speed and rated speed when running on identical fuel delivery curves. This invention provides means for external adjustment modifying the maximum fuel delivery curve of an engine mounted pump during the performance testing of an engine and permits the changing of the shape of the torque delivery curve to adjust any deviate engine so that it comes within specification limits.

Figure 5A:
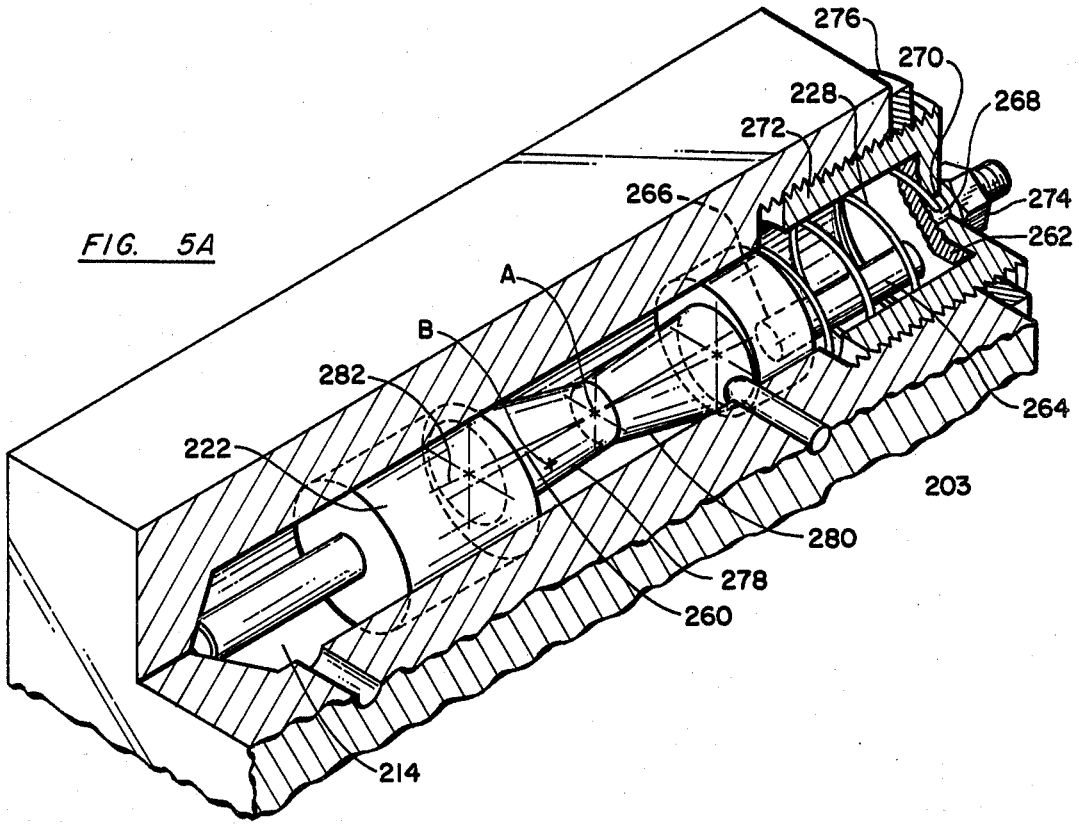
FIG. 5A is a schematic representation of one form of torque control piston suitable for the practice of this invention.

Referring to FIG. 5A, the torque piston 222 is mounted in a cylindrical bore of the pump housing (see FIG. 2) for both axial and rotational movement about its longitudinal axis 260. Axial movement of the torque piston 222 in correlation with pump speed is accomplished by the pressure of the fuel in chamber 214 acting in opposition to the spring force of spring 228 as hereinbefore described.

The rotational orientation of piston 222 may be set and fixed by an adjusting plug 262 which mounts an eccentric pin such as roll pin 264 slidably mounted in passage 266 of the torque piston. The plug 262 is provided with a central stem 268 which extends through an aperture 270 in a threaded spring seat 272 for biasing spring 228 with the plug 262 being locked with the eccentric pin 264 in adjusted angular position by lock nut 274.

It will be apparent that axial adjustment of spring seat 272 sets the bias on spring 270 and spring seat 272 is locked in adjusted position by lock nut 276.

In the embodiment of the invention as shown in FIG. 5A, torque piston 222 is provided with cam segments 278 and 280 which are concentric with a common axis 282. The axis 282 of the cam segments 278 and 280 is shown as being disposed at an angle to the longitudinal axis 260 of the torque piston 222 and intersecting axis 260 at A. With this construction, the rotation of the torque piston 222 will not change the torque delivery curve when the cam follower 203 engages the cam surface on the circle of intersection of cam segments 278 and 280 which is shown as being disposed radially of point A since the cam surface is concentric with the axis of torque piston 222 at that position. It will be apparent that the bias of spring 228 can be adjusted so that cam follower engages this circle of intersection at any desired intermediate speed such as peak torque speed.

Since the pressure in chamber 214 increases with increased engine speed, torque piston 222 is shifted to the right as viewed in FIG. 5A, with increasing speed. Thus, cam follower 203 will engage the cam segment 278 to the left of the circle of intersection as speed increases above peak torque speed and will engage cam segment 278 at, say, point B at rated speed or the maximum operating speed of the engine.

Figure 5B:
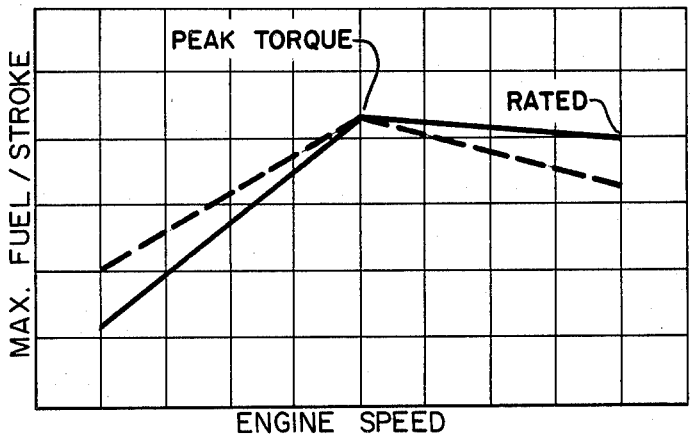
FIG. 5B and 5C are representative maximum fuel delivery and maximum torque curves, respectively obtained from the use of the torque control piston of FIG. 5A.

FIG. 5B represents a maximum fuel delivery curve for an engine. If the desired curve is shown in a solid line, and the actual fuel delivery curve for an engine being performance is shown by a dashed line, it will be apparent that, by rotating the torque piston 222 through the eccentric pin 264, the maximum fuel delivery at rated speed may be increased until the curve coinsides with the solid line in FIG. 5B at which time the desired level at rated speed is achieved. This adjustment will also shift the low speed portion of the fuel delivery curve as shown in FIG. 5B, but will not, in the embodiment shown in FIG. 5A, change the fuel delivery at peak torque speed when the follower 203 is engaging the cam radially of Point A.

Figure 5C:
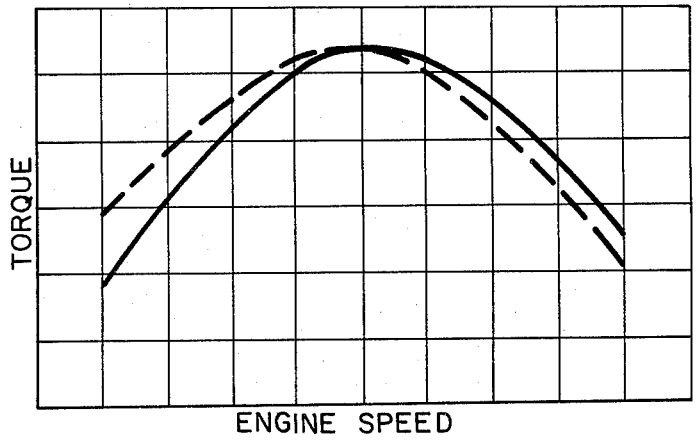

In a diesel engine, the torque delivered by an engine is essentially proportional to the fuel supplied to the engine, so that the torque curve shown in FIG. 5C will be shifted from that shown by the dotted line of FIG. 5C to that shown by the solid line.

Figure 6A:
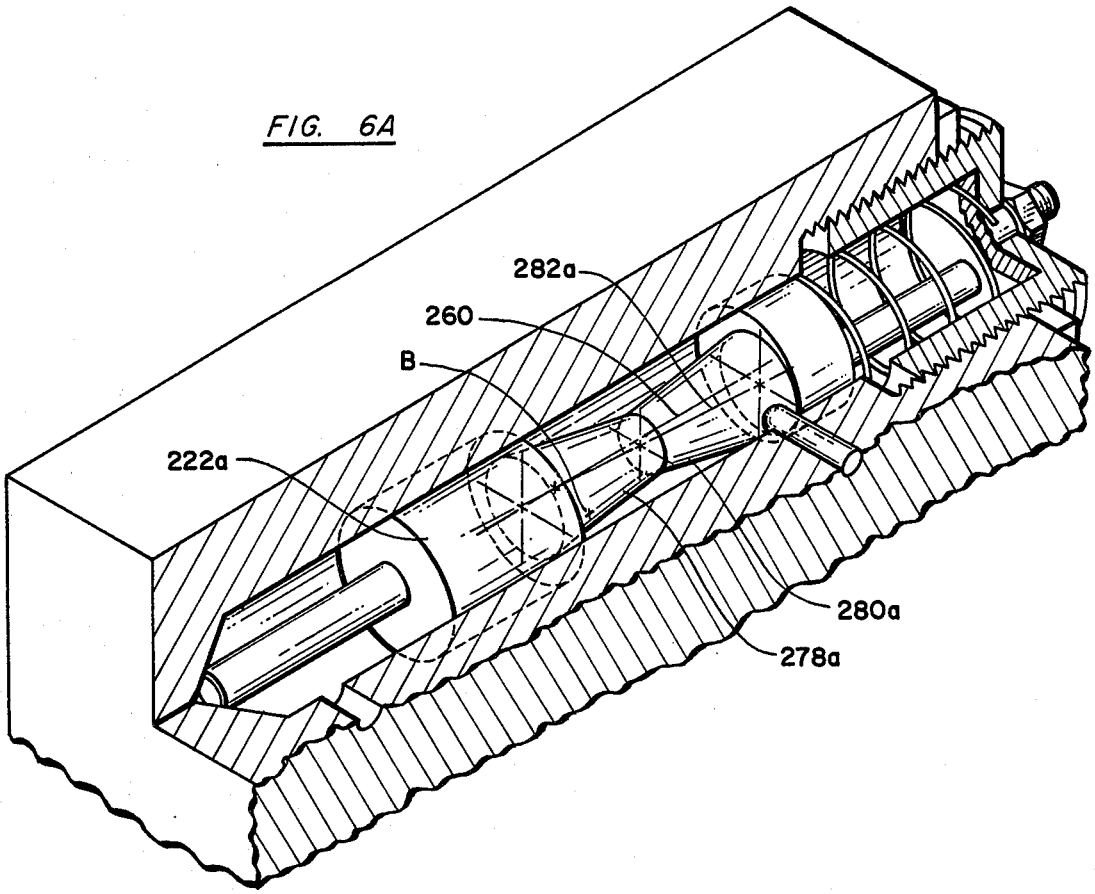
FIG. 6A and 6B are respectively a schematic representation of another form of torque control piston suitable for the practice of this invention and the resultant maximum fuel delivery curve.
Figure 6B:
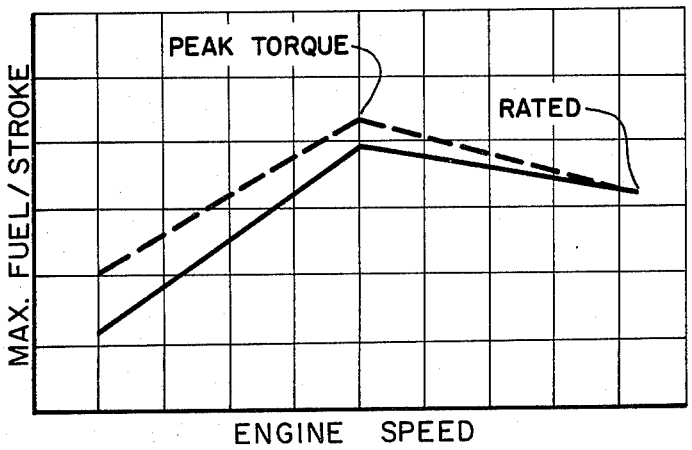

FIG. 6A shows another embodiment of the engine wherein cam segments **278*a* and 280*a* are each concentric with a common axis 282*a* which is disposed at an angle with the longitudinal axis 260 of the torque control piston 222*a*, but intersects axis 260 when the torque piston is at rated speed. Since the cam segment 278*a* is concentric with both axes when the cam follower 203 engages the cam segment at Point B, e.g., at rated speed, rotation of the torque piston 222*a* will not change the maximum fuel delivery curve at that speed as indicated in FIG. 6B. However, the rotation of torque piston 222*a* will shift the fuel delivery curve from the measured level shown by the dotted line of FIG. 6B at peak torque speed until it reaches the desired level represented by the solid line. With the embodiment of FIG. 6A**, the maximum fuel delivery can be adjusted through essentially the entire operating range.

Figure 7A:
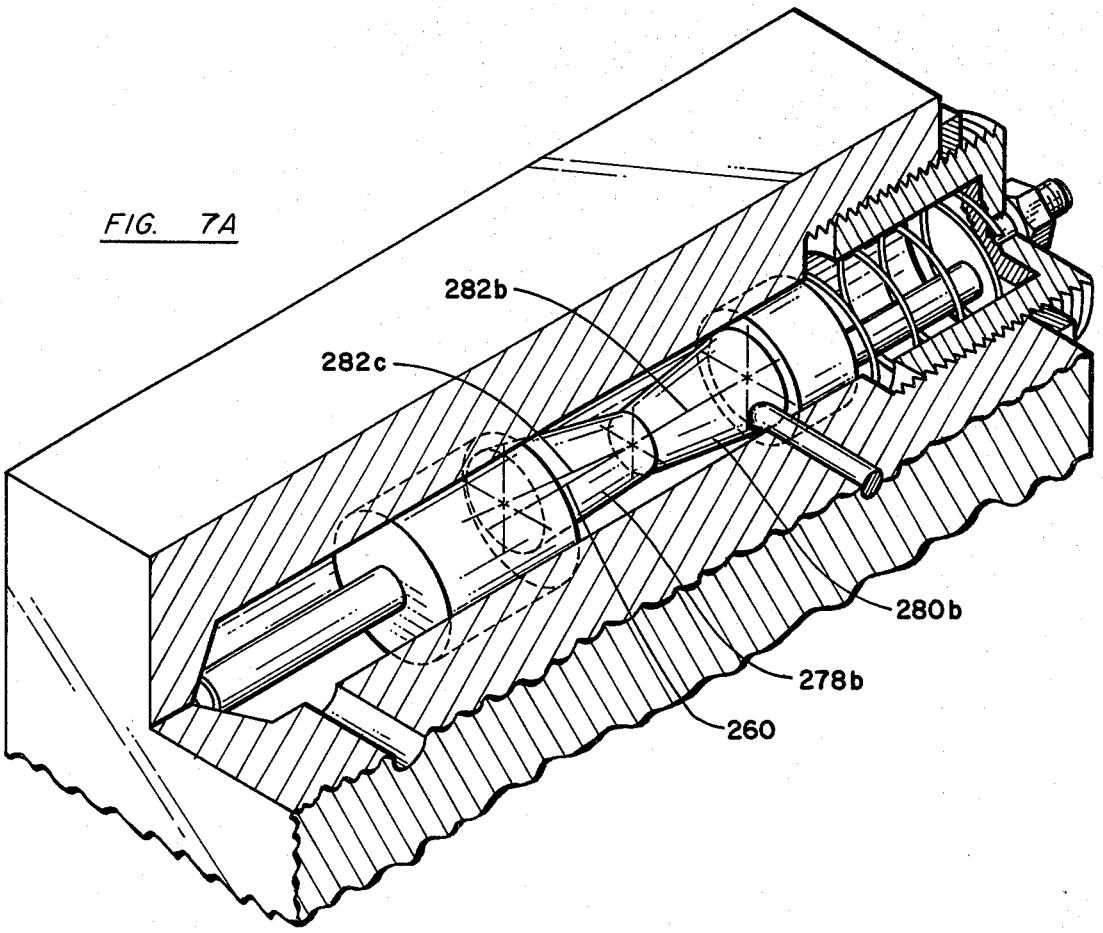
FIG. 7A and 7B are respectively a schematic representation of another form of torque control piston suitable for the practice of this invention and the resultant maximum fuel delivery curve.
Figure 7B:
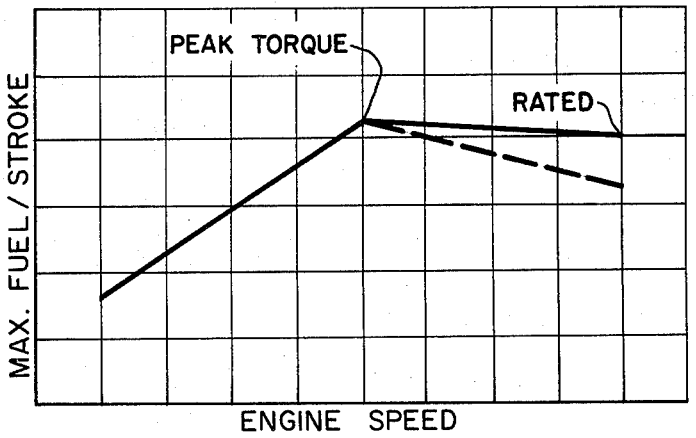

FIG. 7A shows another embodiment of the invention wherein the lower speed portion of the maximum fuel delivery curve up to peak torque speed is controlled by a cam segment **280*b* having an axis 282*b* which is concentric with the longitudinal axis 260 of the torque control piston while the upper speed portion of the maximum fuel delivery curve over the speed range from peak torque speed to rated speed is controlled by cam segment 278*b* which has an axis 282*c* disposed at an angle to axis 260 and intersecting axis 260 at peak torque speed position. The adjustment in maximum fuel delivery which may be made by this embodiment is shown in FIG. 7B**.

Figure 8A:
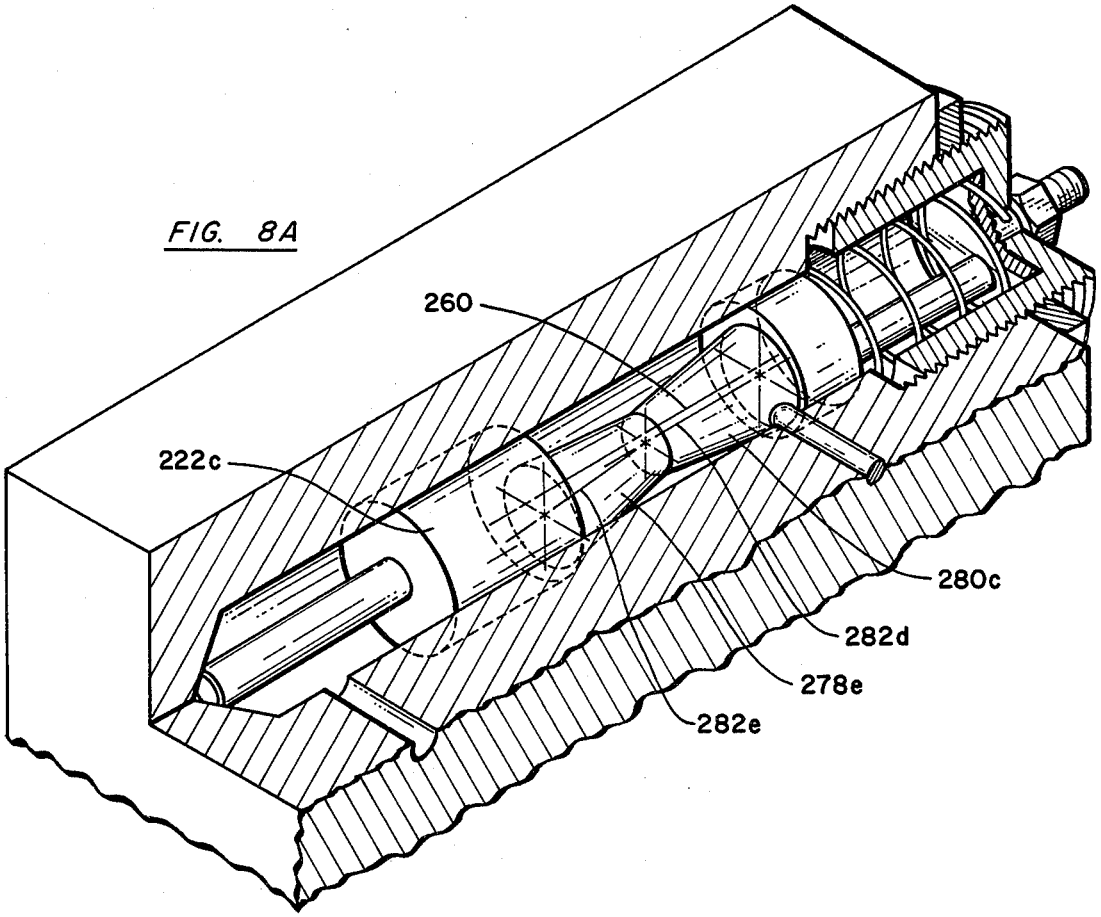
FIG. 8A and 8B are respectively a schematic representation of another form of torque control piston suitable for the practice of this invention and the resultant maximum fuel delivery curve.
Figure 8B:
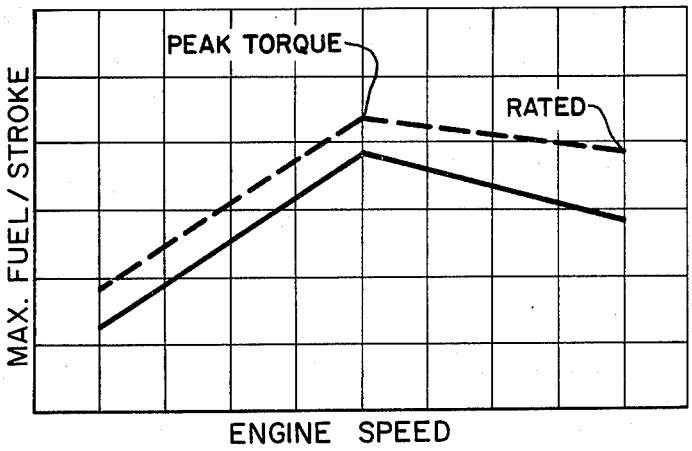

FIG. 8A shows a still further embodiment wherein the axis **282*d* of cam segment 280*c* is parallel to but offset from the axis 260 of the torque piston 222*c*. The axis 282*e* of cam segment 278*e* is also shown as being offset relative to torque piston axis 260 and in addition, is disposed at an angle thereto. With this design, the rotation of torque piston 222*c* will change the maximum fuel delivery curve at all speeds, with the change being uniform up to peak torque speed and an increased amount from peak torque speed to rated speed. Thus, the embodiment of FIG. 8A** provides an arrangement whereby both the level of the maximum fuel delivery curve and its shape can be changed by the rotational position of the torque piston.

From the foregoing, it will be apparent that this invention provides means whereby an externally accessible adjustment can be utilized during the final performance testing of an engine to adjust the maximum fuel delivery curve and change the torque curve over some or all of the speed range as well as to adjust the maximum fuel delivery curve different amounts at rated speed and peak torque speed despite manufacturing variations in a series of similar engines of the same model.

As will be apparent to persons skilled in the art, various modifications, adaptations and variations of the foregoing specific disclosure can be made without departing from the teachings of the present invention.

I claim:

1. In a liquid fuel injection pump suited for the delivery of measured charges of liquid fuel under high pressure to an associated engine comprising a charge pump for delivering successive charges of fuel under high pressure for injection, means for metering the fuel charges delivered by the charge pump to provide a fuel charge measure correlated with engine operating conditions, means for generating a fuel pressure correlated with the speed of the pump and means for overriding the metering means to limit the maximum fuel charge measure delivered by the charge pump in accordance with pump speed, the improvement wherein the overriding means comprises a piston mounted in a bore for longitudinal and rotational movement and longitudinally positioned in response to said pressure correlated with pump speed, said piston having a longitudinally extending cam with a longitudinally continuous peripheral cam surface having a longitudinally extending cam profile section formed by a surface of revolution around an axis which is nonparallel to the longitudinal axis of the piston, adjusting means for adjustably holding the piston in a preselected rotational position, and a follower engageable with said cam surface to vary said maximum fuel charge limit in accordance with the axial and rotational position of the piston.

2. The device in claim 1 wherein the adjusting means is exposed externally of the pump for adjusting the rotational position of the piston during performance testing of an engine.

3. The device of claim 1 wherein the cam surface has a pair of cam profile sections formed by a pair of surfaces of revolution respectively, with one of the surfaces of revolution having an axis disposed at an acute angle to the longitudinal axis of the piston.

4. The device of claim 1 wherein the cam surface has a pair of cam profile sections formed by a pair of surfaces of revolution respectively, with one of the surfaces of revolution having an axis disposed at an angle to the longitudinal axis of the piston and the other surface of revolution having an axis parallel to but offset from the longitudinal axis of the piston.

5. The device of claim 1 wherein the axis of the cam profile section intersects the longitudinal axis of the piston at an intermediate point between the longitudinal ends of the cam profile section.

* * * * *